US008575831B2

(12) United States Patent
Lapatovich et al.

(10) Patent No.: US 8,575,831 B2
(45) Date of Patent: Nov. 5, 2013

(54) EHID LAMP HAVING INTEGRATED FIELD APPLICATOR AND OPTICAL COUPLER

(75) Inventors: Walter P. Lapatovich, Boxford, MA (US); Scott J. Butler, North Oxford, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 13/147,225

(22) PCT Filed: Mar. 10, 2010

(86) PCT No.: PCT/US2010/026776

§ 371 (c)(1), (2), (4) Date: Aug. 1, 2011

(87) PCT Pub. No.: WO2010/104919

PCT Pub. Date: Sep. 16, 2010

(65) Prior Publication Data

US 2012/0217871 A1 Aug. 30, 2012

Related U.S. Application Data

(60) Provisional application No. 61/160,094, filed on Mar. 13, 2009.

(51) Int. Cl.

| | |
|---|---|
| ***H01J 1/50*** | (2006.01) |
| ***H01J 3/20*** | (2006.01) |
| ***H01J 3/32*** | (2006.01) |
| ***H01J 23/10*** | (2006.01) |
| ***H01J 29/76*** | (2006.01) |

(52) U.S. Cl.

USPC ..... 313/161; 313/153

(58) Field of Classification Search

USPC ..... 313/153–162, 153–62

See application file for complete search history.

(56) References Cited

U.S. PATENT DOCUMENTS

| | | | | |
|---|---|---|---|---|
| 2004/0140746 | A1 | 7/2004 | Kurachi et al. | |
| 2007/0138927 | A1 | 6/2007 | Weger | |
| 2008/0258627 | A1 | 10/2008 | Devincentis et al. | |
| 2009/0167201 | A1 * | 7/2009 | Duelli et al. | 315/248 |

FOREIGN PATENT DOCUMENTS

| | | | | |
|---|---|---|---|---|
| WO | WO 2009063205 A2 * | 5/2009 | | H01J 65/04 |

OTHER PUBLICATIONS

International Search Report for PCT/US2010/026776, completed on Oct. 22, 2010 and mailed on Oct. 22, 2010.

* cited by examiner

*Primary Examiner* — Donald Raleigh
(74) *Attorney, Agent, or Firm* — Andrew Martin

(57) ABSTRACT

There is described an EHID lamp that comprises a field applicator, a means for coupling RF power to the field applicator, and a discharge vessel; the discharge vessel being disposed within the field applicator and containing a discharge medium; the field applicator being comprised of a solid, transparent or translucent dielectric material and having an optical control surface and a conductive coating that substantially covers its external surfaces. By combining functions served by otherwise individual components, the EHID lamp of this invention has the potential for reducing parts count, improving RF coupling to the plasma, reducing shadowing, and improving reliability.

19 Claims, 9 Drawing Sheets

EHID LAMP HAVING INTEGRATED FIELD APPLICATOR AND OPTICAL COUPLER

CROSS REFERENCES TO RELATED APPLICATIONS

This present application claims the benefit of U.S. Provisional Application No. 61/160,094, filed Mar. 13, 2009 and PCT Application No. PCT/US2010/026776 filed Mar. 10, 2010, the entire contents of both of which are hereby incorporated by reference.

TECHNICAL FIELD

This invention relates to electrodeless high intensity discharge (EHID) lamps and more particularly to field applicators for such lamps.

BACKGROUND OF THE INVENTION

Electrodeless high intensity discharge (EHID) lamps, in general, include an electrodeless discharge vessel containing a volatilizable fill material and a starting gas. The discharge vessel is mounted in a reflectorized fixture which is designed for coupling high frequency power to the discharge vessel. The high frequency produces a light-emitting plasma discharge within the discharge vessel. The applied electric field is generally colinear with the axis of the lamp capsule and produces a substantially linear discharge within the discharge vessel. The fixture for coupling high frequency energy to the discharge vessel typically includes a planar transmission line, such as a microstrip transmission line, with electric field applicators, such as helices, cups or loops, positioned at opposite ends of the discharge vessel. The microstrip transmission line couples high frequency power to the electric field applicators with a 180° phase shift. The discharge vessel is typically positioned in a gap in the substrate of the microstrip transmission line and is spaced above the plane of the substrate by a few millimeters, so the axis of the discharge vessel is colinear with the axes of the field applicators.

The electric field applicators used to deliver radio frequency (RF), or more particularly ultra-high frequency (UHF), power to the discharge vessel are separate units which for certain applications must be incorporated within the reflector used for harvesting the light from the EHID lamp. External tuning elements or elements embedding into the applicator must be used to deliver power to the lamp during all phases of glow-to-arc transition and plasma impedance swings. Openings need to be created in the reflector to accomodate the applicators thereby reducing the amount of reflective surface and the efficiency of the reflector to gather light, and in some cases weakening the physical integrity of the reflector. Applicators within the reflector volume also cause shadowing effects which are particularly acute in low-wattage EHID lamps where the size of the applicators is increased in proportion to the size of the discharge vessels.

SUMMARY OF THE INVENTION

It is an object of the present invention to obviate the disadvantages of the prior art.

It is a further object of the present invention to provide an EHID lamp that has an integrated field applicator which provides for optical control of the emitted light in addition to applying RF power to the discharge vessel.

In accordance with an object of the invention, there is provided an EHID lamp, comprising a field applicator, a means for coupling RF power to the field applicator, and a discharge vessel; the discharge vessel being disposed within the field applicator and containing a discharge medium; the field applicator being comprised of a solid, transparent or translucent dielectric material and having an optical control surface and a conductive coating that substantially covers its external surfaces.

In accordance with one embodiment of the invention, the field applicator is rotationally symmetric and has a front face and a curved surface, the front face has a transparent conductive coating, the curved surface has a reflective coating that forms an optical reflector having a focal point, and the discharge vessel is located at the focal point.

In accordance with a second embodiment of the invention, the field applicator is cylindrical and has a central axis, an internal cavity, a base, a front face, and a transparent window, the discharge vessel is formed in the front face and sealed by the transparent window, the internal cavity extends from an open end in the base to a closed end below the discharge vessel and has a conductive coating, and the discharge vessel and the internal cavity are coaxial with the central axis.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

The EHID lamp of this invention combines functions served by otherwise individual components and thus has the potential for reducing parts count, improving RF coupling to the plasma, reducing shadowing (which causes dark fields in the projected images), and improving reliability. In particular, the optical function of the reflector is integrated with the field applicator so that the field applicator not only brings RF power to the discharge vessel but it also has optical control surfaces for directing the light emitted from the discharge vessel. In addition, because the discharge vessel is contained within a substantial mass of dielectric material, there is the potential for improved thermal transfer from the discharge chamber walls to the exterior environment which may permit operating the plasma at higher energy densities.

The impedance match in the EHID lamp can be achieved in several ways. In the case of the resonant cavity structures described herein, the position and geometry of the power coupling probe or loop (electrical vs. magnetic coupling) can be designed to provide critical coupling so that the impedance is matched for a specific excitation frequency and/or condition (warm-up, steady-state, etc.). Additionally, the resonator can be utilized as a tuning element in the power source oscillator such that the operating frequency is determined by the frequency at which critical coupling is achieved. In this way the impedance match and power transfer is well behaved during run-up and steady-state. The resonator can be further designed so the unloaded "Q", viz. with the plama off, is very high which supports ignition of the gas within the discharge chamber. When the plasma is on, loaded "Q" is reduced due to the presence of the dissipative plasma.

Figure 1:
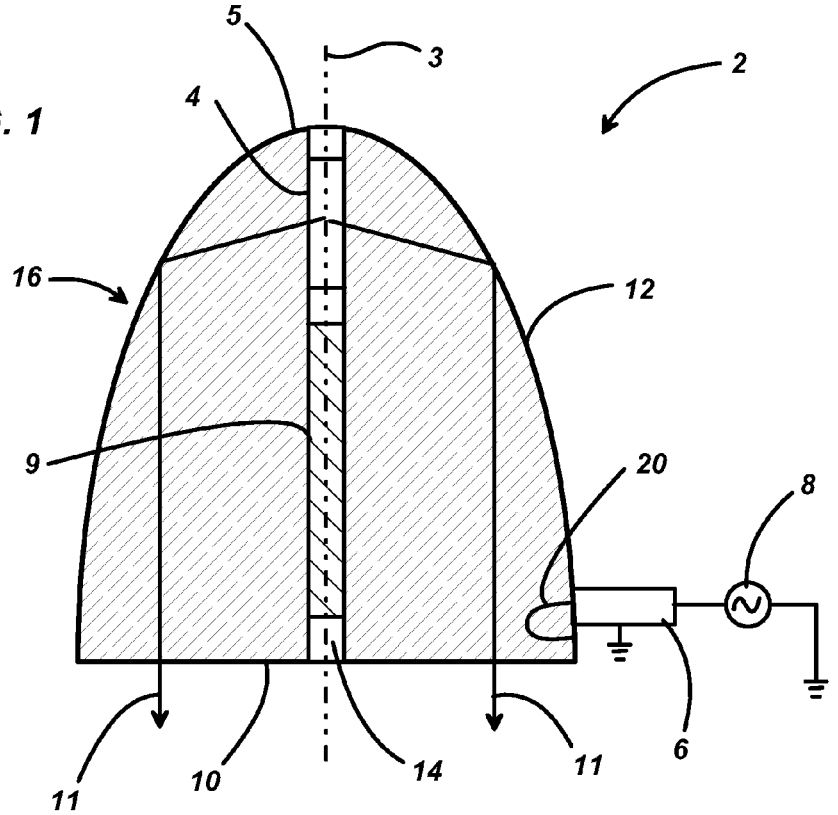
FIG. 1 is a cross-sectional illustration of a first embodiment of an EHID lamp according to this invention.
Figure 2:
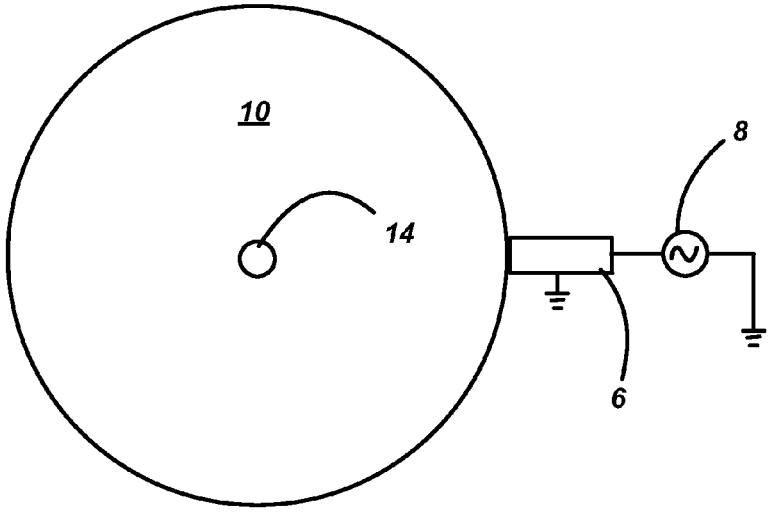
FIG. 2 is a view of the front face of the first embodiment shown in FIG. 1.

Referring to FIGS. 1 and 2, there is shown an embodiment of an EHID lamp 2 according to the present invention. The body of the lamp is comprised of a solid transparent or translucent dielectric material which forms a field applicator 16 that has the shape of an ellipsoid of revolution that has been truncated at the plane including its minor axis. Preferably, the dielectric applicator is made of a transparent material with a high breakdown strength such as fused silica, or a transparent or translucent ceramic such as polycrystalline alumina, aluminum nitride, aluminum oxynitride, dysprosium oxide or yttrium aluminum garnet. The dielectric applicator 16 is rotationally symmetric about its central axis 3 and includes a central bore 14 that extends from the base 5 to the front face 10. Central bore 14 contains tuning element 9 and discharge vessel 4. The discharge vessel 4 contains a discharge medium that is excitable by the applied RF power. The discharge medium typically comprises a chemical fill and a fill gas. The fill gas is generally an inert gas such as xenon, although other gases such as argon and krypton may also be used. The chemical fill may be only mercury or may also comprise any one of the generally known chemical fills used in high intensity discharge lamps, e.g., metal halides and/or pure metals. While the embodiment described consists of an ellipsoid of revolution this should not be considered a limitation. A paraboloid of revolution about the optic axis would work as well. Further complicated geometries intended to maximize radiation output through the front face without concern for imaging quality (non-imaging optics) may also be used.

The tuning element 9 forms the center conductor of a dielectrically loaded re-entrant coaxial resonator (TEM mode). The resonant frequency is determined by the metalized boundary, the dielectric loading and the effective capacitance that loads the gap between the center conductor and the outer wall of the applicator in which the discharge vessel is contained. The tuning element, or slug, may be made from metal, metalized ceramic or cermet and adjusted in length and position within the bore 14 to provide best operation for individual lamps. The impedance match will depend on the choice of chemical filling and the amount of mercury in the lamp since these determine the local electrical properties of the plasma (resistive and reactive parts).

The curved outer surface 12 of the dielectric applicator 16 is coated to provide an optically reflective surface and a boundary for the contained electromagnetic fields. This coating must be optically reflective and electrically conductive to establish the boundary conditions for the RF resonator. The coating can be a simple metallic coating such as silver, aluminium, rhodium or other highly reflective metals. The coating may also be a multi-layer dielectric coating to provide even a higher optical reflectance. In this case, the dielectric coating would be overcoated with a metal such as copper, aluminum, silver or gold. Discharge vessel 4 is positioned near the focal point of the optical reflector (e.g., an elliptical or parabolic reflector) formed by the metalized outer surface 12 so that the emitted light may be gathered and directed out the front face 10 of the lamp as show by arrows 11. The front face 10 is coated with a transparent conductor, such an indium-tin-oxide (ITO) coating, to reduce electromagnetic interference (EMI). The conductive coatings on the front face 10 and the curved outer surface 12 combine to substantially cover the external surfaces of the field applicator. The bore 14 also may have a conductive coating except in the region where the discharge vessel 4 is located.

The lamp 2 is probed to find the appropriate mode to excite the contents of the discharge vessel 4. RF power at the appropriate frequency is used to excite the fill within the cavity to luminescence. The resonant frequency is determined by the dimensions, the dielectric constant of the material and the capacitance of the gap. (similar to a foreshortened coaxial resonator/reentrant cavity resonator operating in TEM mode, See, e.g., T. Koryu Ishii, (1995) *Handbook of Microwave Technology: Components & Devices*, Academic Press, Inc., p. 68.) Determination of resonant frequency can be accomplished by measuring the input impedance of the structure using a network analyzer, or other similar measurement methods.

Figure 3:
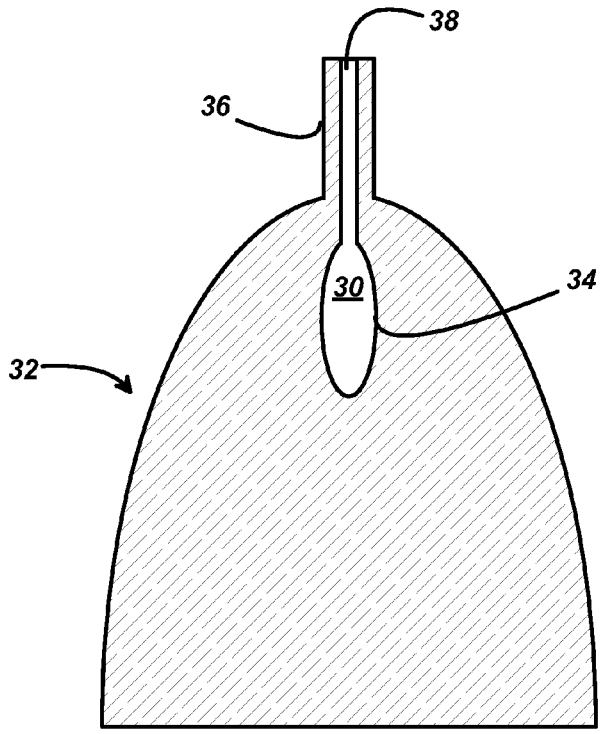
FIG. 3 is a cross-sectional illustration of an alternate embodiment of a dielectric applicator according to this invention.

RF power source 8 is coupled to the dielectric applicator 16 through coaxial connector 6 and coupling loop 20 which is embedded in the dielectric material. The coaxial connector 6 has a grounded shield that is electrically connected to the metalized outer surface 12, the transparent conductor coated on the front face 10, and the conductive coating in the bore 14, if present. A coupling loop is shown which couples to the magnetic field (FIG. 1), alternatively a probe can be used which is electrically coupled (FIG. 3). In both cases the ground connection is connected to the metalized outer surface, and the center conductor is connected to the loop or probe (the metallization is removed in the vicinity of the central conductor to prevent shorting where the probe/loop enters the dielectric material). In the case of the loop, it is usual for the loop to be terminated on the outer metalized surface.

Figure 11:
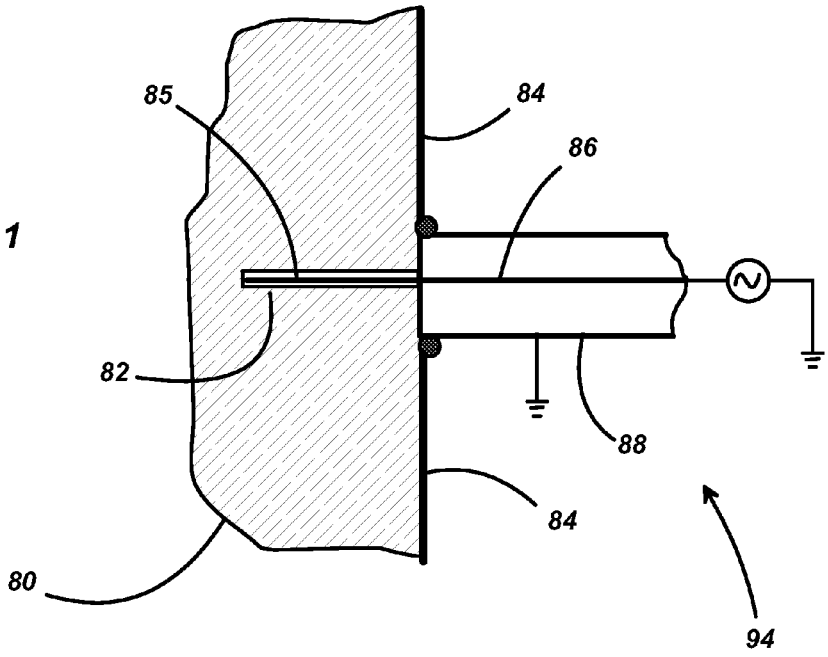
FIGS. 11 and 12 are magnified cross-sectional illustrations of alternate means for coupling RF power to the EHID lamp.
Figure 12:
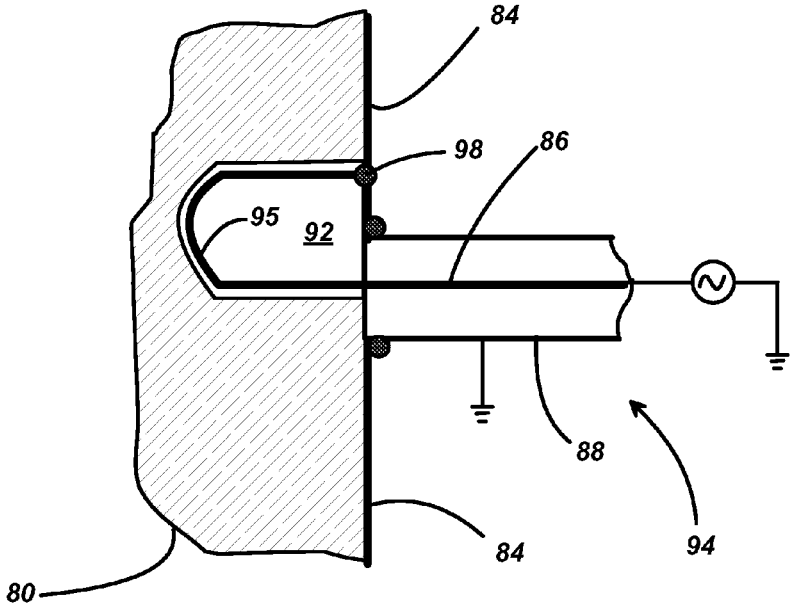

As shown with greater magnification in FIGS. 11 and 12, instead of embedding the probe or coupling loop in dielectric material 80, a small hole 82 may be drilled into the dielectric material 80 and the probe 85 inserted into the hole. (FIG. 11) Probe 85 is electrically connected to the center conductor 86 of the coaxial connector 94 and the metalized surface 84 of the dielectric material is electrically connected to the grounded shield 88 of coaxial connector 94. The metallization has been removed from the region surrounding the point where the probe enters the dielectric material in order to prevent shorting the probe. In the case of a coupling loop 95 (FIG. 12), a slot 92 may be cut into the dielectric material 80 to accommodate the coupling loop 95 which is electrically connected to center conductor 86. As above, the metallization in the vicinity of where the coupling loop enters dielectric material 80 has been removed to prevent shorting the center conductor 86 at that point. However, the end 98 of loop 95 is terminated in an electrical connection with the metallization.

The matching network may be printed on solid dielectric, or shaped into a cone or series of fingers or other geometric conducting structures having a complex impedance at operating frequency. The impedance may include capacitive and inductive reactance parts. In the simplest case the tuning is accomplished via tuning element 9, the operating frequency, and the geometry and position of the coupling probe or loop. The resonant structure is used as part of the power source (oscillator) to determine the frequency so that the impedance is always matched. Alternatively a fixed frequency operation with a separate matching network electrically connected to the coaxial connector transition can be implemented.

FIG. 3 shows an alternate embodiment of a dielectric applicator 32 for an EHID lamp. The dielectric applicator 32 has generally the same ellipsoidal shape as in FIG. 1 except that there is no central bore. Instead, discharge vessel 34 has been integrally formed with the dielectric applicator 32. Preferably, this is accomplished by molding the applicator 32 with a fugitive core having the shape of the discharge chamber 30 and then removing the fugitive core by heating after the shape of the applicator has been molded. The dielectric applicator 32 further includes capillary tube 36 having a bore 38 in communication with the discharge chamber 30 so that the fugitive core can be removed and the discharge chamber 30 filled with the desired discharge medium. The capillary 36 can then be hermetically sealed by conventional ceramic sealing techniques after the discharge chamber 30 has been filled.

Figure 4:
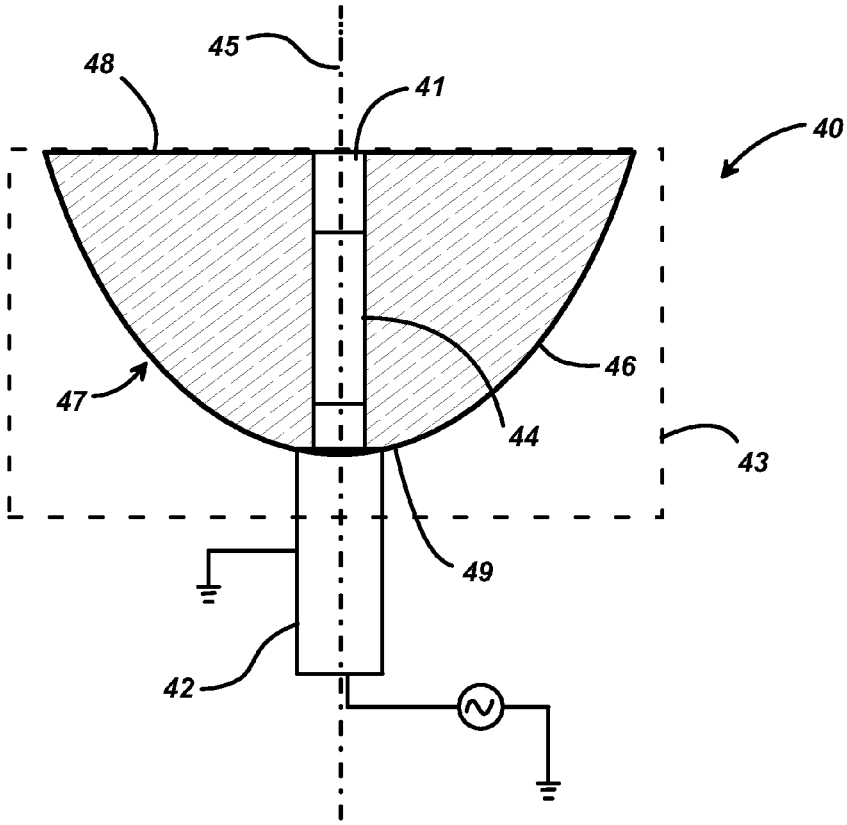
FIG. 4 is a cross-sectional illustration of a second embodiment of an EHID lamp according to this invention.

A second embodiment of the present invention is shown in FIG. 4. The EHID lamp 40 has a dielectric applicator 47 in the shape of a solid parabolid with a central bore 41 that contains discharge vessel 44. The dielectric applicator 47 is rotationally symmetric about central axis 45. The axes of both the discharge vessel 44 and the central bore 45 are coaxial with central axis 45. The curved surface 46 of the dielectric applicator 47 is metalized to form a reflector and contain EMI radiation as in FIG. 1. Discharge vessel 44 is located at the focus of the reflector formed by the metallized curved surface 46. The front face 48 is coated with a transparent conductor to allow the light from the lamp to be emitted in a forward direction and to contain the electromagnetic fields within the lamp. Although the solid dielectric applicator 47 also serves as a heat sink for the lamp 40, the dielectric applicator 47 may be further enclosed by an additional heat sink 43 as shown by the dashed line. Coaxial connector 42 at the base 49 of the lamp has a ground shield that is electrically connected to the metallized curved surface 46 and the conductive coating of the front face. Central bore 45 has a conductive coating except in the region where the discharge vessel 44 is located. The conductive coating in the bore is electrically isolated from the metallized curved surface 46 and is electrically connected to the center conductor of the coaxial connector 42. Power is coupled coaxially as in a coaxial applicator or termination fixture. (Air-dielectric termination fixtures for EHID lamps are well known. (See e.g., U.S. Pat. No. 3,787,705).) The frequency of operation is limited by Q-factor. Power is deposited to the discharge via the gap between the center conductor and the outer transparent metalization. In this case the center conductor is directly excited by the input connector. The arrangement forms a dielectrically loaded transmission line which is terminated by the discharge impedance.

Figure 5:
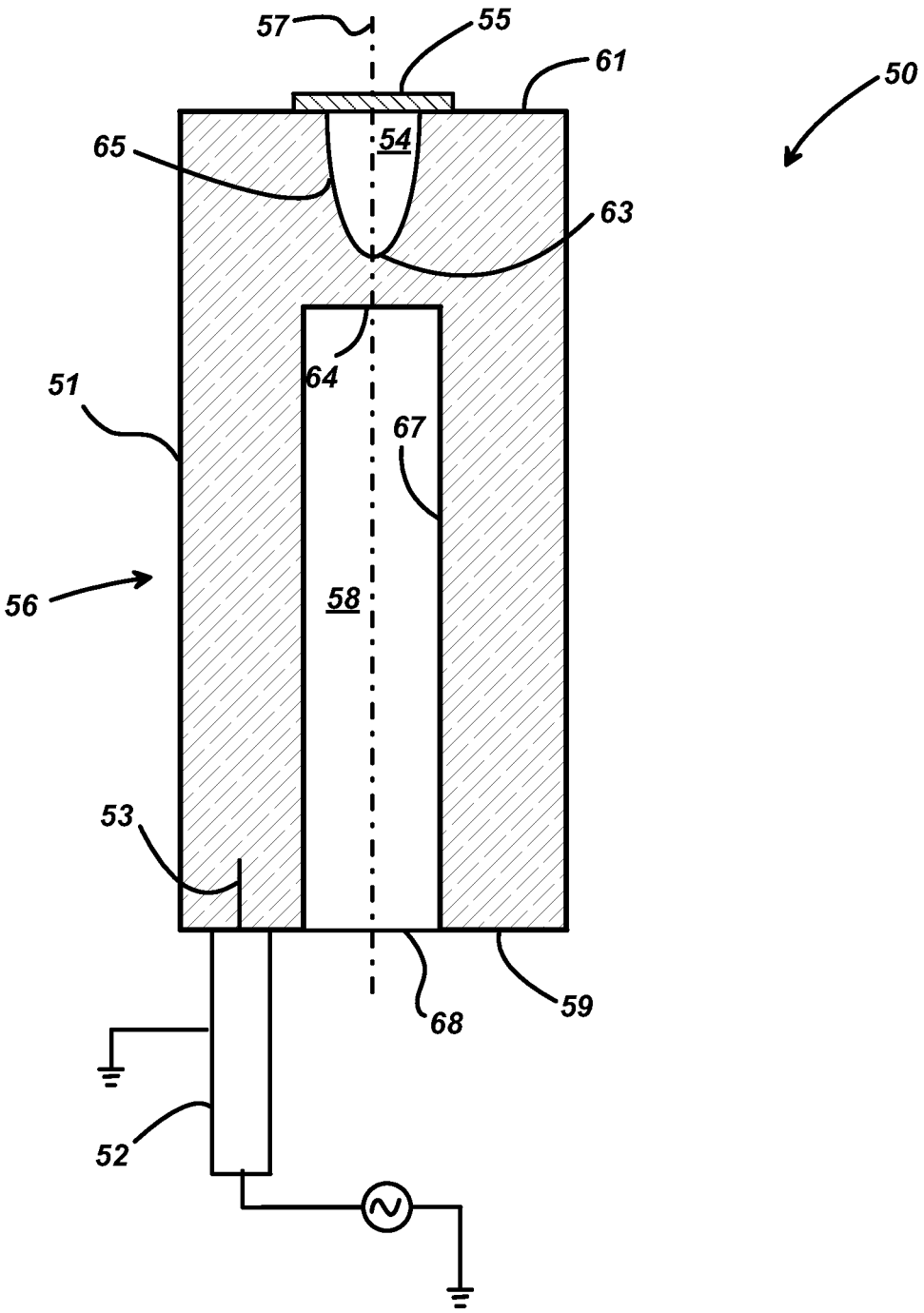
FIG. 5 is a cross-sectional illustration of a third embodiment of an EHID lamp according to this invention.

A third embodiment of an EHID lamp 50 according to the present invention is shown in FIG. 5. In this embodiment, the dielectric applicator 56 is a cylinder of a dielectric material that has a parabolic discharge chamber 54 formed in the front face 61 and an internal cavity 58 that extends from an open end 68 at base 59 to a closed end 64 at point just below the base 63 of the discharge chamber 54. The internal cavity 58 is cyindrical and has curved walls 67. The internal cavity 58, discharge chamber 54, and dielectric applicator 56 are coaxial with central axis 57. The surfaces of dielectric applicator 56 are metalized, including exterior surface 51, front surface 61, base 59 (except for a small area in the vicinity of probe 53) and the curved walls 67 and closed end 64 of internal cavity 58. The curved surface 65 of the discharge vessel forms a parabolic reflector that focuses light emitted from the discharge in a forward direction. This embodiment is more suited to the dielectric material being dense, translucent or opaque white with a diffuse scattering surface such as thick polycrystalline alumina. The discharge cavity forms a mini-integrating sphere with the sampling port replaced with the transparent window 55. Curved surface 65 is not metalized. The dielectric material scatters and absorbs some of the light. The curved surface 65 and transparent window 55 form an aperature lamp with a forward peaked light distribution. A dielectric reflector could be applied to the curved surface 65 to further enhance the effect.

The discharge chamber 54 is sealed with flat, transparent window 55, preferably comprised of sapphire, that has been coated with a transparent conductor such as ITO and is electrically connected to the metalized surfaces and the ground shield of coaxial connector 52. In combination, the discharge chamber 54 and transparent window 55 form a discharge vessel that can be filled with a discharge medium. Power is coupled into the lamp by coaxial connector 52 and probe 53 which is embedded in the dielectric material and electrically connected to the center conductor of coaxial conductor 52. The metalized dielectric applicator 56 forms a coaxial resonator with the discharge chamber 54 located in the vicinity of field maxima. More particularly, a dielectrically loaded coaxial transmission line is formed which is short-circuited at one end and terminated in the discharge vessel at the other end. The resonant frequency is determined by the electrical length of the transmission line and the impedance presented by the discharge vessel.

Figure 6:
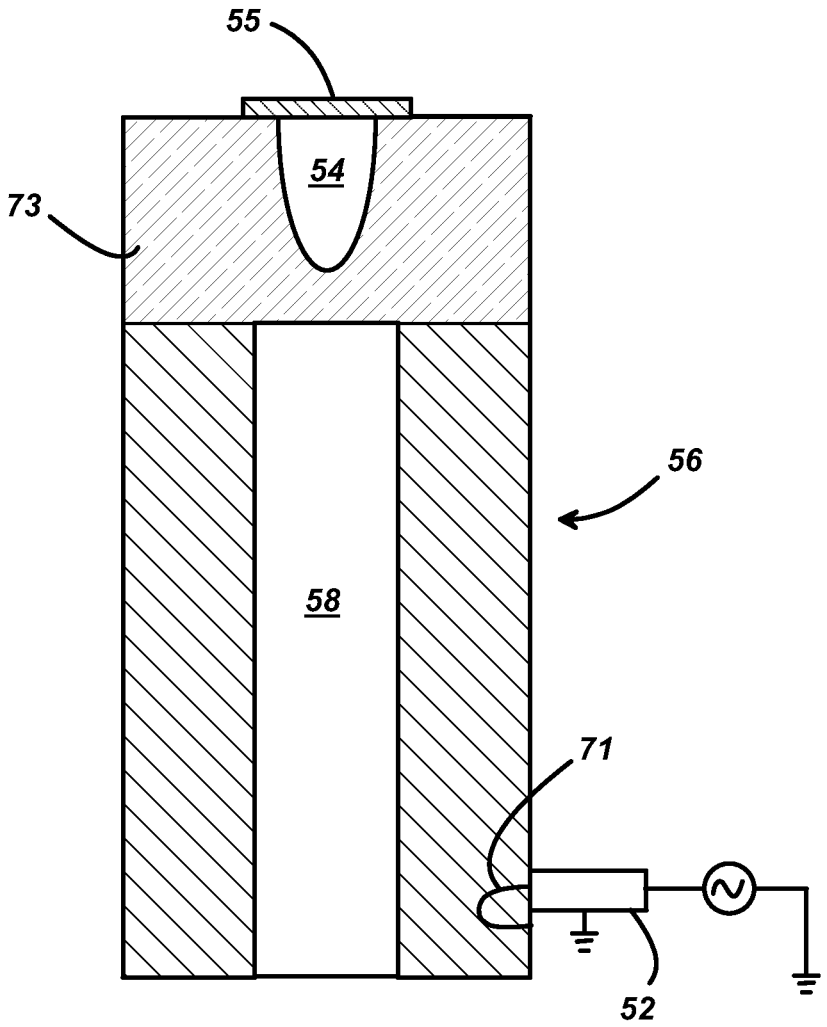
FIG. 6 is a cross-sectional illustration of a first alternate embodiment of the EHID lamp shown in FIG. 5.

Preferably, the entire dielectric applicator 56 is comprised of polycrystalline alumina. However, in a first alternate embodiment shown in FIG. 6, only the forward portion 73 of the dielectric applicator 56 that contains the discharge chamber 54 is comprised of polycrystalline alumina. In this embodiment, the power is coupled by coupling loop 71. The remaining portion of the applicator can be filled with many other dielectric materials to lower cost, lower weight, reduce the dimensions, etc. In a simple case, the remaining dielectric could be air (in which case the relevant metalized surfaces containing the remaining dielectric would at least in part be replaced by a metal casing). The use of other dielectrics, quartz, fluid-filled quartz tubing, or opaque ceramics with very high dielectric constants could be advantageous. In the first case, the fluid-filled dielectric could be used to transfer and dissipate heat from the forward portion 73. In the second case, the discrete or gradient dielectric material could be used as a tuning element.

Figure 7:
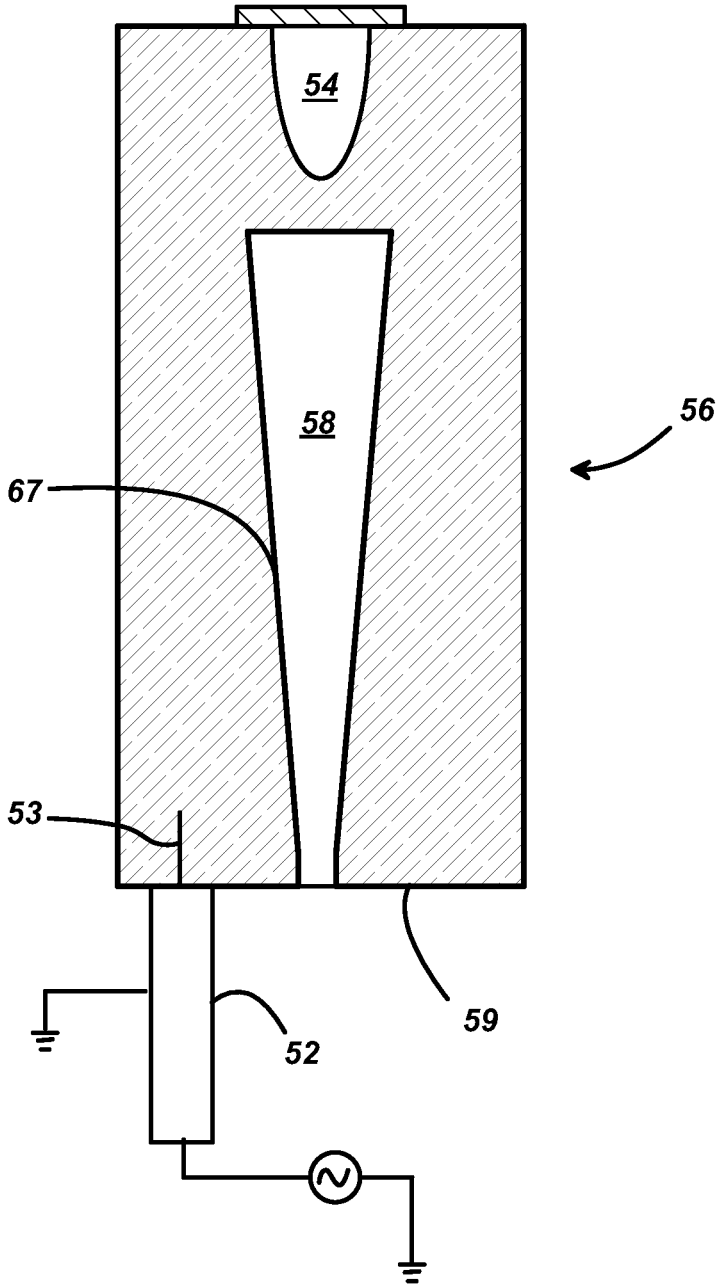
FIG. 7 is a cross-sectional illustration of a second alternate embodiment of the EHID lamp shown in FIG. 5.
Figure 8:
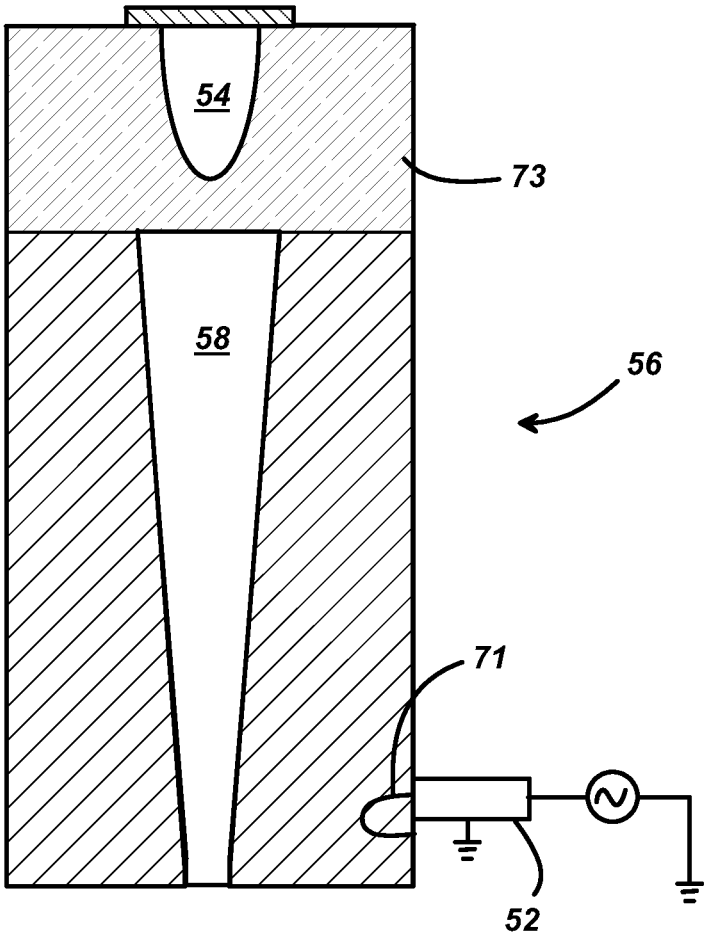
FIG. 8 is a cross-sectional illustration of a third alternate embodiment of the EHID lamp shown in FIG. 5.

With regard to FIG. 7, there is shown a second alternate embodiment of the EHID lamp shown in FIG. 5. Here, the interior cavity 58 of the applicator 56 is conical in shape with the vertex of the cone located at base 59 of the applicator 56. The internal taper formed by the conical shape modifies the electrical length and provides impedance transformation. As in FIG. 5, the entire applicator 56 may be formed of polycrystalline alumina or, as shown in FIG. 8, only the forward portion 73 is formed of polycrystalline alumina.

Figure 9:
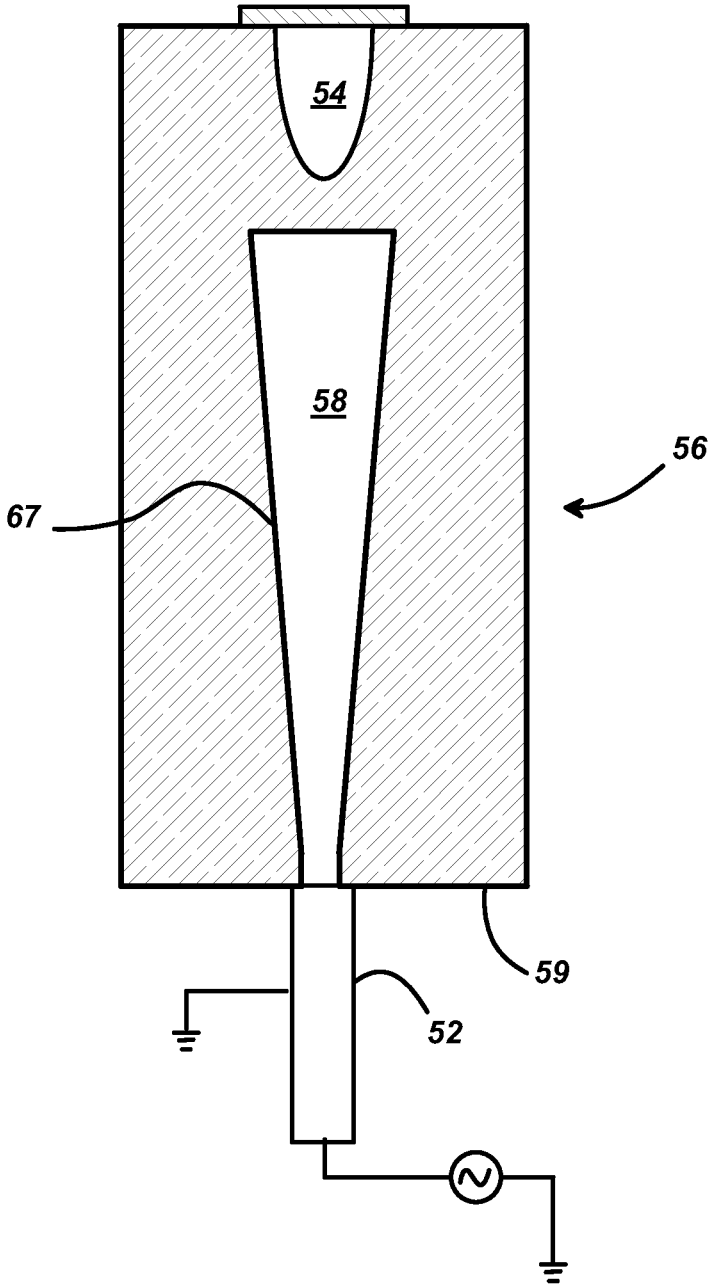
FIG. 9 is a cross-sectional illustration of a fourth alternate embodiment of the EHID lamp shown in FIG. 5.
Figure 10:
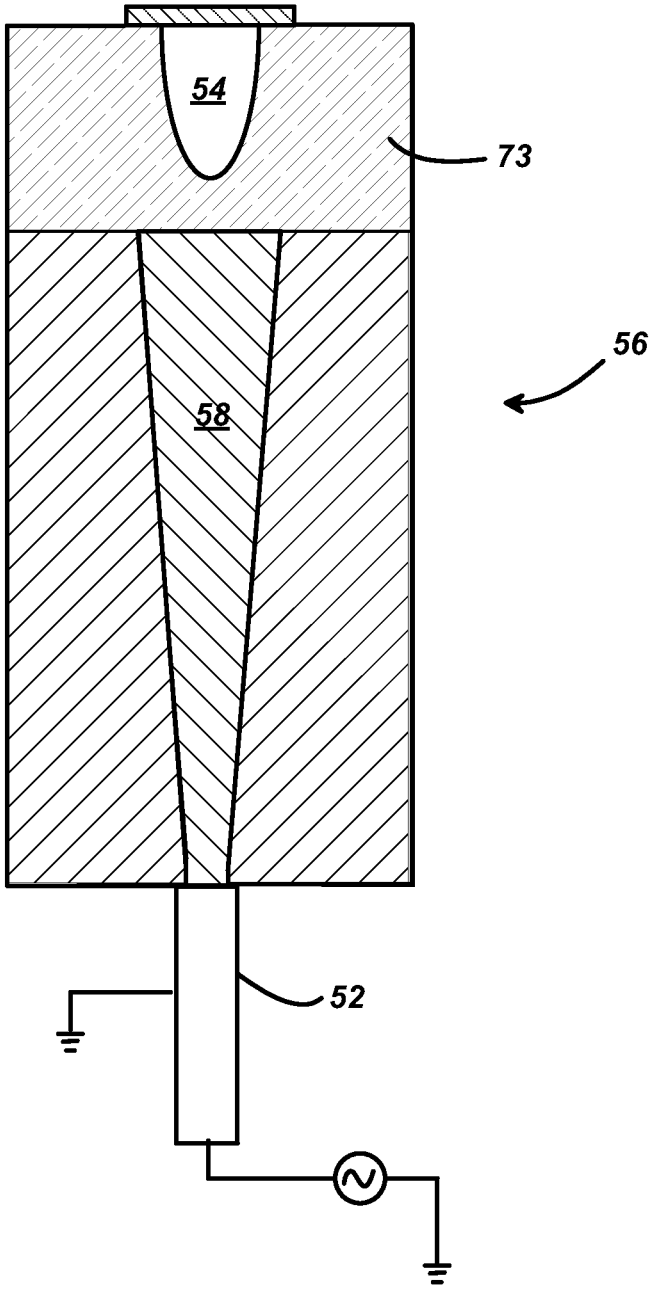
FIG. 10 is a cross-sectional illustration of a fifth alternate embodiment of the EHID lamp shown in FIG. 5.

FIGS. 9 and 10 represent fourth and fifth alternate embodiments of the EHID lamp shown in FIG. 5. As in FIGS. 7 and 8, the internal cavity 58 has a conical shape except that the power is coupled directly to the internal cavity 58 like in a termination fixture or coaxial applicator. The internal cavity 58 can be empty as shown in FIG. 9 or filled with a conductor as shown in FIG. 10 in which only the front portion 73 of dielectric applicator 56 is a polycrystalline alumina ceramic as in FIGS. 6 and 8. The metalized surfaces of internal cavity 58 are electrically isolated from the exterior surfaces by removing a small ring of the metallization on base 59 around the opening of the cavity. The base 59 and the other exterior surfaces are electrically connected to the ground shield of the coaxial connector 52. The metallized surfaces of the internal cavity 58 form the boundary of the inner conductor which is connected to the center conductor of the coaxial connector 52. The inner conductor (including cavity 58) can be a solid conductive metal, a hollow metallic conductor or a metalized insulating material (dielectric) to provide better mechanical stability.

While there have been shown and described what are at present considered to be the preferred embodiments of the invention, it will be apparent to those skilled in the art that various changes and modifications can be made herein without departing from the scope of the invention as defined by the appended claims.

We claim:

1. An EHID lamp, comprising:

a field applicator, a means for coupling RF power to the field applicator, and a discharge vessel;

the discharge vessel being disposed within the field applicator and containing a discharge medium;

the field applicator being comprised of a solid, transparent or translucent dielectric material and having an optical control surface and a conductive coating that substantially covers its external surfaces wherein the field applicator has an internal cavity that has a partial conductive coating that is electrically isolated from the conductive coating on the external surfaces.

2. The lamp of claim 1, wherein the field applicator is rotationally symmetric and has a front face and a curved surface, the front face having a transparent conductive coating, the curved surface having a reflective coating that forms an optical reflector having a focal point, and the discharge vessel being located at the focal point.

3. The lamp of claim 2, wherein the field applicator has a shape of a solid of revolution.

4. The lamp of claim 3, wherein the optical reflector is an elliptical or parabolic reflector.

5. The lamp of claim 1, wherein the internal cavity is a central bore and contains the discharge vessel and a tuning element.

6. The lamp of claim 2, wherein the RF power is coupled to the field applicator through a probe or coupling loop that is inserted or embedded in the dielectric material and wherein the conductive coating on the external surfaces is electrically connected to a ground.

7. The lamp of claim 2, wherein the discharge vessel is integrally formed with the field applicator.

8. The lamp of claim 1 wherein RF power is coupled to the lamp by means of a coaxial connector having a ground shield that is electrically connected the conductive coating on the external surfaces and a center conductor that is electrically connected to the partial conductive coating in the internal cavity.

9. The lamp of claim 1 wherein the field applicator is cylindrical and has a central axis, a base, a front face, and a transparent window, the discharge vessel being formed in the front face and sealed by the transparent window, the internal cavity extending from an open end in the base to a closed end below the discharge vessel and having a conductive coating, and the discharge vessel and the internal cavity being coaxial with the central axis.

10. The lamp of claim 9, wherein the internal cavity is cylindrical.

11. The lamp of claim 9, wherein the internal cavity is conical with the vertex of the cone located at the base of the field applicator.

12. The lamp of claim 9, wherein a forward portion of the field applicator is comprised of polycrystalline alumina.

13. The lamp of claim 9, wherein the internal cavity is filled with a conductor that is electrically isolated from the conductive coating on the external surfaces.

14. The lamp of claim 9, wherein the conductive coating of the internal cavity is electrically connected to the conductive coating on the external surfaces.

15. An EHID lamp, comprising:

a field applicator, a means for coupling RF power to the field applicator, and a discharge vessel;

the discharge vessel being disposed within the field applicator and containing a discharge medium;

the field applicator being comprised of a solid, transparent or translucent dielectric material and having an optical control surface and a conductive coating that substantially covers its external surfaces wherein the field applicator has a central axis, an internal cavity extending from an open end in the base to a closed end below the discharge vessel and having a conductive coating isolated from the conductive coating on the external surfaces.

16. The lamp of claim 15, wherein the internal cavity is cylindrical.

17. The lamp of claim 15, wherein the internal cavity is conical with the vertex of the cone located at the base of the field applicator.

18. The lamp of claim 15, wherein a forward portion of the field applicator is comprised of polycrystalline alumina.

19. The lamp of claim 15, wherein the internal cavity is filled with a conductor that is electrically isolated from the conductive coating on the external surfaces.

* * * * *